US009902605B2

(12) United States Patent
Lux et al.

(10) Patent No.: US 9,902,605 B2
(45) Date of Patent: Feb. 27, 2018

(54) HYDRATION SYSTEM

(71) Applicant: Jason Daniel Lux, Cedar Hills, UT (US)

(72) Inventors: Jason Daniel Lux, Cedar Hills, UT (US); Karl Aaron Smith, Bakersfield, CA (US)

( * ) Notice: Subject to any disclaimer, the term of this patent is extended or adjusted under 35 U.S.C. 154(b) by 9 days.

(21) Appl. No.: 15/162,415

(22) Filed: May 23, 2016

(65) Prior Publication Data

US 2017/0022042 A1 Jan. 26, 2017

Related U.S. Application Data

(60) Provisional application No. 62/165,942, filed on May 23, 2015.

(51) Int. Cl.

| | |
|---|---|
| ***B67B 7/00*** | (2006.01) |
| ***B67D 1/10*** | (2006.01) |
| ***A45F 3/20*** | (2006.01) |
| ***B67D 1/00*** | (2006.01) |
| *A45F 3/16* | (2006.01) |

(52) U.S. Cl.

CPC ..... *B67D 1/10* (2013.01); *A45F 3/20* (2013.01); *B67D 1/0004* (2013.01); *B67D 1/0082* (2013.01); *A45F 2003/166* (2013.01); *B67D 2001/0093* (2013.01)

(58) Field of Classification Search

CPC ..... B67D 1/10; B67D 1/0004; B67D 1/0082; B67D 2210/00131; A45F 3/20; A45F 2003/166; A41D 2400/46; A61J 15/0011; A61J 15/0088

See application file for complete search history.

(56) References Cited

U.S. PATENT DOCUMENTS

| | | | | | |
|---|---|---|---|---|---|
| 2,969,064 | A * | 1/1961 | Metz | A61G 7/05 | 251/9 |
| 4,966,580 | A * | 10/1990 | Turner | A61J 15/0011 | 215/11.4 |
| 5,060,833 | A * | 10/1991 | Edison | A45F 3/16 | 215/388 |
| 5,085,349 | A * | 2/1992 | Fawcett | A45F 3/20 | 220/703 |
| 5,201,442 | A | 4/1993 | Bakalian | | |
| 5,265,769 | A * | 11/1993 | Wilson | A47G 19/2266 | 222/175 |
| 5,571,260 | A | 11/1996 | Krug | | |
| 5,645,404 | A | 7/1997 | Zelenak | | |
| 7,007,502 | B2 | 3/2006 | Kreutzmann et al. | | |
| 7,712,681 | B2 * | 5/2010 | Fulkerson | B05B 7/1404 | 118/302 |
| 8,220,664 | B1 | 7/2012 | Teetzel et al. | | |
| 8,371,832 | B2 * | 2/2013 | Rotem | A61M 5/14228 | 417/477.7 |
| 8,961,461 | B2 * | 2/2015 | Stewart | A61M 5/16831 | 604/131 |
| D732,392 | S * | 6/2015 | Duran | D9/516 | |

(Continued)

*Primary Examiner* — Paul R Durand
*Assistant Examiner* — Randall Gruby

(57) ABSTRACT

An automatic pump hydration delivery system includes a power source, master power switch, electric pump, timer delay module, pressure switch, backflow prevention structure (such as a one-way valve), conduit or tubing, bite valve, and may contain a reservoir or be retrofitted onto prior-art reservoirs or hydration bladders.

20 Claims, 3 Drawing Sheets

(56) References Cited

U.S. PATENT DOCUMENTS

| | | | | |
|---|---|---|---|---|
| 9,624,083 | B2 * | 4/2017 | Tuggle | B67D 1/0004 |
| 2001/0051788 | A1 * | 12/2001 | Paukovits | A61J 7/0053 604/67 |
| 2004/0045980 | A1 | 3/2004 | Robins | |
| 2004/0055254 | A1 * | 3/2004 | Setton | A45F 3/20 53/410 |
| 2004/0069008 | A1 * | 4/2004 | Kreutzmann | A42B 3/048 62/457.2 |
| 2007/0119866 | A1 * | 5/2007 | Sheppard | A42B 3/048 222/175 |
| 2009/0140005 | A1 * | 6/2009 | Reichert | A45F 3/20 222/95 |
| 2010/0044396 | A1 * | 2/2010 | Skillern | A45C 11/20 222/209 |
| 2010/0101253 | A1 * | 4/2010 | Searle | A41D 13/0025 62/259.3 |
| 2013/0150823 | A1 | 6/2013 | Montgomery et al. | |
| 2017/0081209 | A1 * | 3/2017 | Robert | B01D 29/27 |

* cited by examiner

HYDRATION SYSTEM

CROSS REFERENCE TO RELATED APPLICATIONS

Priority is claimed from U.S. Provisional Patent Application 62/165,942, filed May 23, 2015, which is hereby incorporated by reference

BACKGROUND

A hydration pack is a hydration system built as a backpack or waist pack containing a reservoir or "bladder" that is commonly made of rubber or flexible plastic. The reservoir contains a capped mouth or screw top for filling with liquid and a hose or flexible tube that allows the wearer to drink hands-free. The hose ends with a "bite valve" that opens when the user bites down on it. Hydration packs are commonly used for outdoor recreational activities, such as hiking, bicycling, and kayaking, as well as for military applications.

A hydration system is intended to help its user carry liquid to support the physical effort involved in the activity. Such systems for consumers were first sold to cyclists, and by the 1990s had also found a substantial market among hikers. Familiar commercial models can also be recognized occasionally worn by western military personnel in southwest Asia.

The reservoir usually has a capacity of one or more liters. Typically the largest dimension is the vertical one, taking advantage of the long vertical dimension of the human torso. The hose joins the bladder very near the bottom of the bladder, to maximize the amount of accessible liquid. The reservoir changes in volume as it is gradually emptied.

A reservoir is usually carried in a protective fabric shell of a backpack. The hose exits the reservoir and is mounted to the pack, such as on a shoulder strap, to make it easily accessible to the mouth of the user while participating in a sport activity.

The reservoir may also be incorporated into an integrated backpack/reservoir design with, for example, channels in a shoulder strap for the hose to pass through. The reservoir, rather than being mounted in the back pack may also be mounted upon a bicycle, or other sport apparatus, such as a kayak, weight training machine, treadmill, ATV, UTV, or any exercise equipment or vehicle system.

Hydration of the human body is fundamental to health and wellness. There have been many improvements throughout time to make it easier, more convenient, and safer to stay properly hydrated. During all types of strenuous activity heart rates increase and loss of liquid is expedited through perspiration. It has become necessary to provide a readily available hydration system that is easy and convenient to use while heart rates are elevated.

When using a hydration back a user places the bite valve in his mouth, and when liquid is desired bites down on the bite valve and mostly by sucking liquid is drawn through the bite valve into the user's mouth. However, strenuous activities often make it difficult or energy consuming to provide suction to receive a hydration liquid.

Several patents have issued that have added an electronic pump system to a hydration reservoir to solve this problem. The current art includes U.S. Pat. Nos. 5,201,442, 5,571,260, 5,645,404, 7,007,502, and 8,220,664. A problem with these systems is they often provide a distraction and added complication for the user. They are also known to not be consumer friendly due to the wiring being visible to the user and the associated fear of electric shock. Some designs have electrical switches at the bite valve which introduces the possibility of shock, and may potentially introduce toxic materials into the bite valve. Accordingly, while these designs may assist in suction, they introduce complications that in themselves are as or even more problematic.

The result is that many people are deterred from the use of hydration packs, and do not keep themselves properly hydrated during many activities, as hydration is inconvenient or requires interruption to their activity to get a drink. Their performance and health then suffers.

SUMMARY

An aspect of the invention is a hydration delivery system for automatically delivering hydration liquid from a reservoir, through a drinking tube, and to a user's mouth with the assistance of an electronic pump. The pump is activated by the user with a simple bite of the bite valve; this is made possible by a pressure sensing pressure switch. The system includes a timer delay module for protecting the pump from running while dry.

Another aspect is a hydration system that provides hydration with minimum effort from a user, allowing the user to keep more complete focus on the current activity engaged in.

Another aspect is to provide a hydration system that is pump actuated with just a bite on the bite valve, alleviating undue distraction.

Another aspect is to provide protection to the pump with the use of an optional timer delay module.

Another aspect is to provide a pump hydration system that is consumer friendly and does not need to have a visible actuating system.

Another aspect is a pump system that may be retrofitted onto other hydration bladders and reservoirs. (For example, Camelbak Anitidote™ Reservoir, Hydrapak Elite™ Reservoir and all other hydration packs and reservoirs.)

Another aspect is a system that may also be used to spray to cool the user, clean, and share.

Another aspect is that a filter may be connected in line with the tubing before or after the pump.

Another aspect is that the battery pack is rechargeable and may be recharged with solar panel/s.

Another aspect is that the tubing or reservoir contains a quick refill port.

Another aspect is to provide a hydration liquid at a tested and proven flow rate.

Another aspect is to provide several uses (several gallons of water) on one battery charge.

Another aspect is that the electric pump may be submersible.

Another aspect is that the hydration system is lightweight.

DETAILED DESCRIPTION

Figure 1:
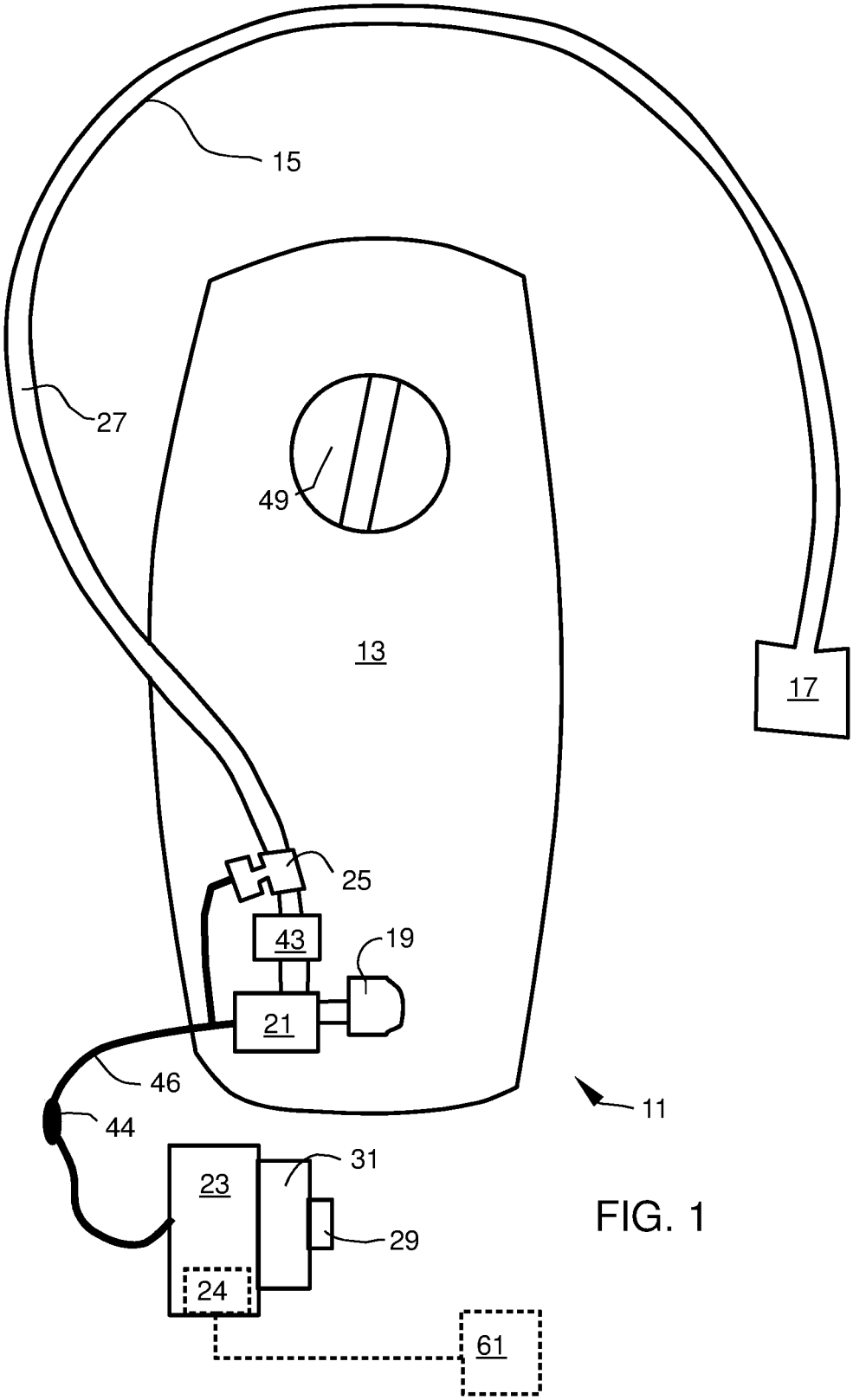
FIG. 1 is a schematic of a hydration system.

Referring to FIG. 1, which shows an exemplary hydration device 11, the hydration device 11 has a reservoir 13, here in the form of a flexible bladder, a liquid filler port 49, a conduit 15, in form of a flexible rubber tube, and a bite valve 17. The conduit provides liquid communication between a reservoir outlet 19 where liquid can exit the reservoir 13 and the bite valve, so that a user with the bite valve 17 in his mouth can obtain water from the reservoir 13.

The liquid in the conduit 15 including at the bite-valve 17 is pressurized by an electric pump 21. The electric pump 21 may be located at any point along the conduit, but is suitably located, as illustrated, at or near the reservoir outlet 19, with the remaining conduit in the form or a flexible tube extending to the bite valve 17. The end at the conduit is a free end, which allows the user to easily locate, place the bite valve in this mouth and move during use. The pressurized portion of the conduit 27 is between the bite valve 17 and the location in the conduit where there is backflow prevention structure to prevent backflow and maintain pressure at the bite valve. If the electric pump 21 is a positive displacement pump, the backflow prevention structure is the pump 21. The backflow prevention structure may also be a check valve or one-way valve 43 mounted anywhere along the conduit 15. For example, a one-way valve 43 may be mounted, before or after the pump 21, or at or near the reservoir exit, or be incorporated into the exit of the reservoir (In which case the entire conduit is a pressurized portion.)

Pressure is maintained in the pressurized portion so that when a user opens the bite valve 17, pressurized liquid flows through the bite valve 17 with no or little suction by the user.

The pump 21 may be any suitable water pump that is small, and light. In portable applications the pump is suitably electric and powered by a portable electric power source. These include any one of several mini micro submersible pumps used, for example, in aquariums, water displays, table-top fountains, and the like, and pumps used in medical devices, such any suitable peristaltic pump. The pump may, for example, be a positive displacement, or be any one of several impeller pump configurations.

It is desired that back-flow of water from the conduit back into the reservoir be prevented in order to maintain liquid pressure in the pressurized portion 27 after the pump stops running when the pressure limit is reached. This can be accomplished by use of a one-way valve 43, or by a positive displacement pump (such as a peristaltic pump). An impeller submersible pump 21 in combination with a one-way valve 43 is suitable.

An electric pump 21 is powered by a suitable power source. In a mobile application a portable electrical source 23 might be required. A suitable portable power source 23 is any replaceable or rechargeable battery system with suitable voltage and capacity to operate the electric pump 21. The pump is not operated continuously, but only operated intermittently during use, but the battery should be capable of lasting a few hours for one or several athletic workouts. Suitable battery systems include any of the various lithium rechargeable battery packs. Recharging circuits 24 for the power supply 23 may be included in the hydration device, and be capable or charging the battery pack from solar panels 61 mounted on the pack top or a separate structure, such as a bicycle. Non-rechargeable electrical power systems are also contemplated. In a stationary system, (such are for stationary exercise or medical/hospital applications) the pump can be powered by conventional electrical line power.

The pressure switch 25 is electrically connected to the power supply 23 and the electric pump 21 to turn the electric pump on and off. The pressure switch operates as a pressure sensor and a switch for turning power on and off to the pump based upon sensed pressure. The pressure switch 25 is in liquid or pressure communication with pressurized portion 27 or the conduit 15. It is configured to close or turn on the electrical switch when pressure in the conduit falls below a specified pressure. When the user takes a drink through the bite-valve, the pressure in the pressurized portion 27 falls, which is sensed by the pressure switch 25, which closes the switch, which then turns on the electric pump. When the bite valve is released or closed the pressure in the pressurized portion 27 is restored to the specified pressure. When the pressure is restored, the pressure switch 25 opens the switch and turns off the pump.

The pressure sensor function of the pressure switch may be based upon any suitable technology, such as piezoresistive, capacitive, electromagnetic, or piezoelectric. The pressure switch may also comprise separate liquid pressure and electrical switch components that are electrically connected.

Figure 2:
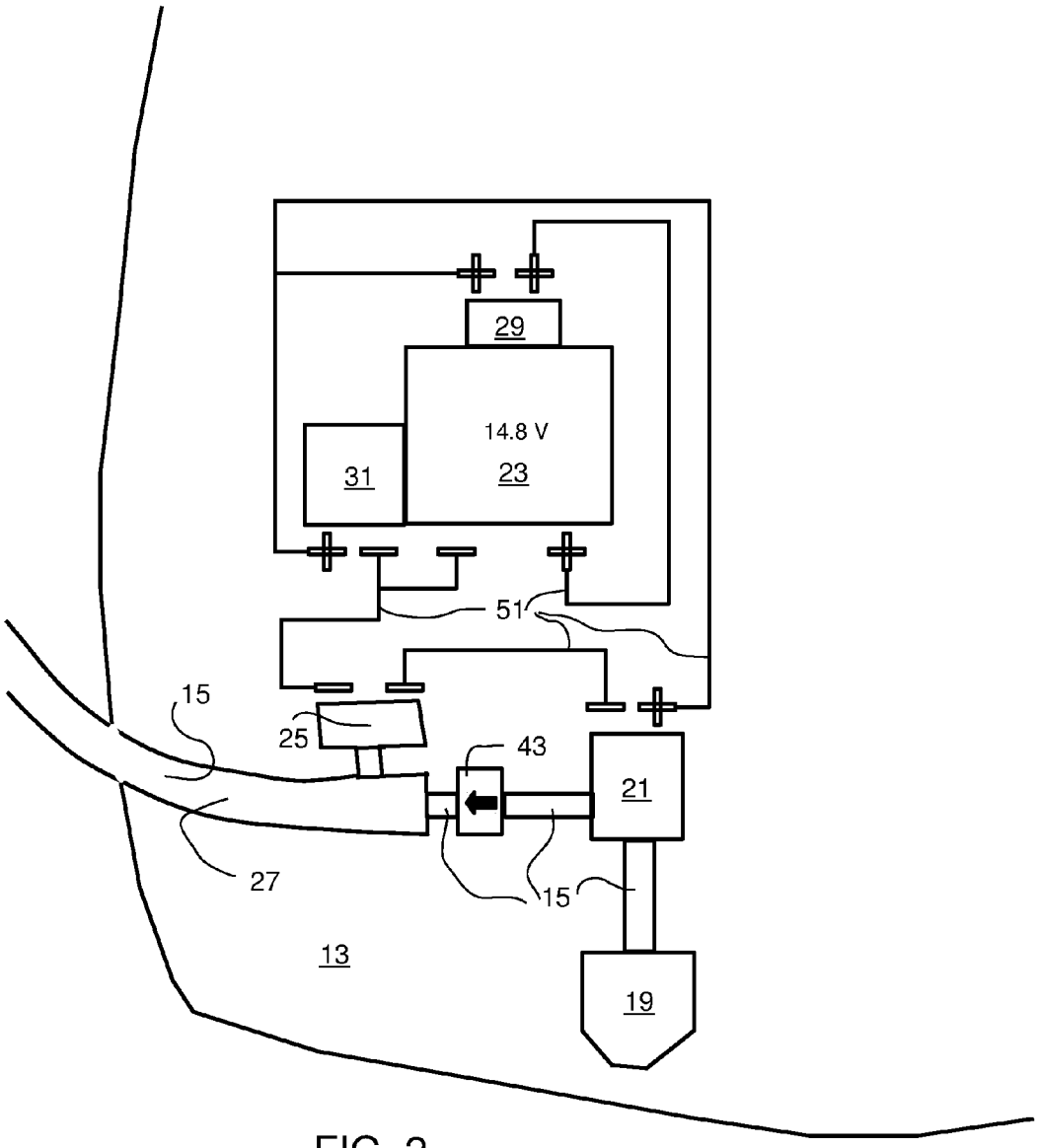
FIG. 2 is a detail of a portion of the schematic of FIG. 1.

FIG. 2 is a detail schematic of the hydration device showing the reservoir outlet 19 and showing liquid connections and electrical connections 51 to the electric pump 21 and associated components. The electric pump 21 is mounted inline on the liquid conduit 15 near the reservoir 13 outlet positioned to pump liquid from the reservoir. A one-way valve 43 is also mounted inline in the conduit 15 near the reservoir outlet to prevent backflow from the conduit back into the reservoir. A pressure switch 25 is mounted in the conduit 15 after the electrical pump (in the pressurized portion 27) to sense pressure, and to switch the electric pump 21. The conduit then continues from the pressure switch to the bite-valve (not shown).

The master power switch, battery pack, and timer delay module are electrically connected together and to the pressure switch and electric pump by electrical conductors. An exemplary connection schematic 51 is shown in FIG. 2. The electrical conductors may be wires 46 (FIG. 1), or any configuration of electrical conductor, which may be tabs, flat sheets, or other geometry, particularly if components are integrated together as described in FIGS. 3 and 4, and may contain suitable connect/disconnect devices 44.

The basic system above may be equipped with additional components to add usability and safety. For example a master control switch 29 is used to completely turn off the system.

One problem with electrical pumps is that if they run dry, they can overheat and fail. This could happen when the reservoir is empty. The pump cannot restore liquid pressure, so the pump will continue to run indefinitely. To prevent this, a timer delay module 31 may be used to automatically switch off the motor after a predetermined delay time, usually a few seconds, but significantly longer than a typical sip by a user. The delay module can then be reset, for example, by manually operating a button switch or turning the system on and off with the master control switch 29.

The system described above can use conventional hydration pack components, the only nonstandard components being the electrical pump, pressure switch, and power supply. Accordingly, these components can be easily retrofitted to upgrade an existing hydration system by removing the installed conduit from the reservoir exit, installing the components, and installing the conduit to the electrical pump. The components may be integrated into one or more modules to make a retrofit installation easier and may be supplied to the consumer as a hydration control system or kit without a reservoir.

Figure 3:
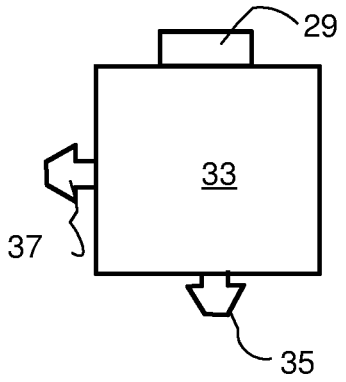
FIG. 3 is a schematic of modular system.

Referring to FIG. 3, an integrated module-A 33 is shown that contains within the housing the electric pump, one-way check valve, pressure switch, timer delay module, power source, with necessary fitting and adapters. On the housing is the master control switch 29, a liquid inlet 35 and a liquid outlet 37.

Figure 4:
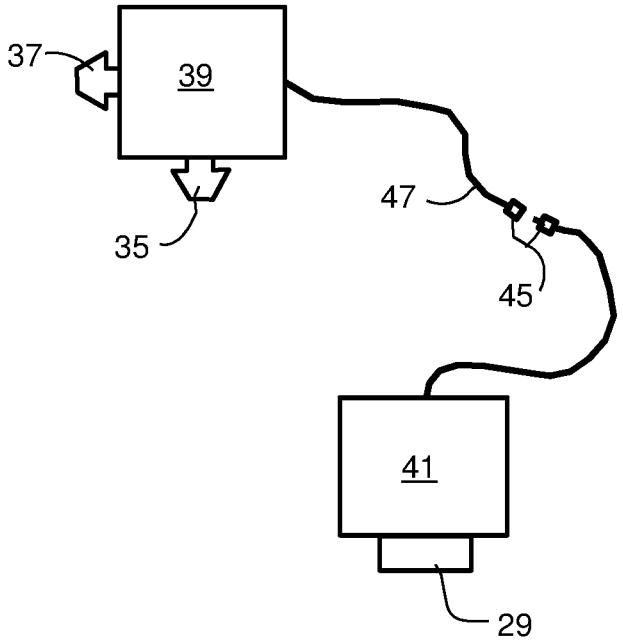
FIG. 4 is a schematic of another modular system.

Referring to FIG. 4, integrated module-B contains within a housing the electrical pump, one-way check valve, pressure switch and necessary fittings and adapters, along with a liquid inlet 35 and a liquid outlet 37. Integrated module-C contains within a housing the power source with master control switch 29. The timer delay module may be within integrated module B or C, 39, 41. Module B and C are connected by electrical wire 47, which for convenience incorporate a suitable connector, such as bottle jack connector 45. The liquid inlets 35 and outlets 37 may be ¼ inch barbed fittings, but may also be other suitable fittings, such as one of several quick connect fittings. Hydration conduits frequently comprise ¼ inch flexible tubing. The inlets and outlets are dimensioned appropriately, or to any other diameter tubing that may be used. The modular systems in FIGS. 3 and 4 are easily incorporated into existing hydration pack construction.

The system may optionally be equipped with spraying valves, dual conduits and bite valves for sharing, where components are duplicated or shared.

EXAMPLE

A hydration system essentially as described above for FIG. 1 and FIG. 2 was constructed and tested. The system functioned by first turning the master power switch on. The conduit or drinking tube had a pressure switch with a sensor in liquid communication with the drinking tube that completes a circuit to turn on the electric pump when the pressure in the drinking tube decreases due to a bite on the bite valve at the end of the tubing. The one-way valve was placed in line with the drinking tube between the pressure switch/sensor and the electric pump. When the user stops biting the bite valve the pump continues to run just long enough to pressurize the drinking tube. That pressure lets the pressure switch/sensor know to switch off the pump. The one-way check valve keeps the liquid from flowing back into the reservoir, allowing the drinking tube to maintain its pressure.

To avoid damaging an electric pump that cannot be run while dry there is the option of adding a timer delay module to the hydration system. The timer delay module will shut off power to the electric pump if the pump runs for the full preset amount of time. In an embodiment the timer delay module setting is 6 seconds, but the system is not limited to this setting. It is believed that most users to take a drink for 2-4 seconds at a time. The timer delay module provides a safety shut off for when the hydration reservoir or bladder is emptied. The timer system may be reset by turning off and back on the master power switch if the motor run time reaches the preset shut off point of the preset 6 seconds.

The setting on the pressure switch in the preferred embodiment is 2 PSI, but the system is not limited to such a setting. The pressure switch/sensor may be adjustable. A pressure sensor and the timer delay module may also be part of the same module, allowing a lower manufacturing cost and a more compact system. It is also preferred that the one-way check valve be a 0 PSI valve to allow for a suitable liquid flow rate. It is to be understood that other one-way valves with different PSI settings may be used. The one-way valve was from U.S. Plastic Corporation, item # 57173 (mini check valve ¼ inch barb, with no spring). An example of a suitable timer control module is the "Multi-purpose Timer relay circuit" offered for sale by 3rdbrakeflasher.com. An example of a suitable pump for the hydration system is the DC6-12 V Mini Micro Submersible pump JT-160 offered for sale by EBAY seller "Goldpart". A suitable power source is a 14.8 V rechargeable lithium battery pack.

The pressure switch/sensor may be configured in many ways to arrive at the same intended result of just biting the bit valve at the end of the drinking tube to actuate the electric pump. The many other configurations will become apparent to those skilled in the art with a review of the included specifications and drawings. There has been significant testing to arrive at selected liquid flow rates, selected fittings, and tubing diameters. The modules shown in FIG. 3 and FIG. 4 are configured to allow simple retrofitting onto prior art hydration packs such as the Camelbak Rogue™ and all other hydration packs, systems, bladders, and reservoirs that may benefit from such a configuration herein disclosed.

It is also contemplated to use a voltage drop safety switch or a liquid sensor to act as a safety shutoff for the electric pump. Other objects will become apparent to those skilled in the art.

Other advantages and objects of the present invention will become apparent to those skilled in the art with a review of the included specifications and drawings. Many various types of pumps, reservoirs, valves, actuation devices, tubing, power sources, quick connects and other obvious features may be used in conjunction with the said system to take advantage of the great benefits of a timer delay module and pressure switch/sensor.

While this invention has been described with reference to certain specific embodiments and examples, it will be recognized by those skilled in the art that many variations are possible without departing from the scope and spirit of this invention, and that the invention, as described by the claims, is intended to cover all changes and modifications of the invention which do not depart from the spirit of the invention.

What is claimed is:

1. A hydration device comprising:

a liquid reservoir, a bite valve, a conduit between the liquid reservoir and the bite valve, the conduit including an electric pump inline with the conduit, electrical power supply electrically connected to the electric pump, a pressure switch, the conduit including a pressurized portion between the bite valve and backflow prevention structure that prevents liquid flow back into the reservoir, the pressure switch in liquid pressure communication with a pressurized portion of the conduit to sense the liquid pressure in the pressurized portion, the pressure switch electrically connected to turn on and off the electric pump, the pressure switch configured to switch the electric pump on when pressure in the conduit is below a specified pressure, and switch the pump off when the specified pressure is reached.

2. The device of claim 1 additionally comprising a timer delay module electrically connected to automatically turn off the pump after a set delay time.

3. The device claim 1 wherein the backflow prevention structure is a one-way valve to prevent liquid from the pressurized portion of the conduit from back-flowing into the liquid reservoir.

4. The device claim 1 wherein the backflow prevention structure is the electric pump, and the pump is a positive displacement pump.

5. The device of claim 1 wherein the electric pump is an impellor pump and the backflow prevention structure comprises a one-way valve to prevent liquid from the pressurized portion of the conduit from back-flowing into the liquid reservoir.

6. The device of claim 1 wherein the conduit comprises flexible tubing.

7. The device of claim 1 wherein the electric power supply is a rechargeable battery system.

8. The device of claim 1 wherein the electrical power supply includes a recharging circuit.

9. The device of claim 8 wherein the recharging circuit includes solar panels.

10. The device of claim 1 additionally comprising a master power switch for electrically disconnecting the electrical power supply from the pressure switch and the electric pump, additionally comprising a timer delay module electrically connected to automatically turn off the pump after a set delay time, wherein the electric pump is an impellor pump and the backflow prevention structure comprises a one-way valve to prevent liquid from the pressurized portion of the conduit from back-flowing into the liquid reservoir.

11. The device of claim 10 wherein the electric pump, one-way check valve, pressure switch, timer delay module, master power switch, and power source with necessary fittings, electrical connections and adaptors are integrated into a single integrated housing module.

12. The device of claim 10 wherein the electrical pump, one-way check valve, pressure switch and necessary fittings, electrical connections and adaptors are integrated into a first integrated housing module, and the power source and master power switch are integrated into a second integrated house, and first and second modules are electrically connected.

13. A control system for hydration device comprising:

a bite valve, a conduit configured for attachment to a liquid reservoir and ending at the bite valve, the conduit including an electric pump inline with the conduit, electrical power supply electrically connected to the electric pump, a pressure switch, the conduit including a pressurized portion between the bite valve and backflow prevention structure that prevents liquid flow back into a reservoir, the pressure switch in liquid pressure communication with a pressurized portion of the conduit to sense the liquid pressure in the pressurized portion, the pressure switch electrically connected to turn on and off the electric pump, the pressure switch configured to switch the electric pump on when pressure in the conduit is below a specified pressure, and switch the pump off when the specified pressure is reached.

14. The system of claim 13 additionally comprising a master power switch for electrically disconnecting the electrical power supply from the pressure switch and the electric pump, additionally comprising a timer delay module electrically connected to automatically turn off the pump after a set delay time, wherein the electric pump is an impellor pump and the backflow prevention structure comprises a one-way valve to prevent liquid from the pressurized portion of the conduit from back-flowing into the liquid reservoir.

15. The system of claim 14 wherein the electric pump, one-way check valve, pressure switch, timer delay module, master power switch, and power source with necessary fittings, electrical connections and adaptors are integrated into a single integrated housing module.

16. The system of claim 15 wherein the electric power supply is a rechargeable battery system.

17. The system of claim 14 wherein the electrical pump, one-way check valve, pressure switch and necessary fittings, electrical connections and adaptors are integrated into a first integrated housing module, and the power source and master power switch are integrated into a second integrated house, and first and second modules are electrically connected.

18. The system of claim 17 wherein the electric power supply is a rechargeable battery system.

19. A method for supplying water to a bite valve from a liquid reservoir when the bite valve is activated, providing a pressurized portion of a conduit that is in pressurized fluid communication with the bite valve, such that when the bite valve is activated pressure in the pressurized portion directs fluid out through the bite valve, pumping fluid into the pressurized portion from a fluid reservoir when pressure in the pressurized portion drops below a predetermined value from activation of the bite valve and stop pumping of the fluid when pressure in the pressurized portion above the predetermined value.

20. The method of claim 19 wherein pumping is stopped if the pressure in the pressurized portion does not rise to the predetermined value within a predetermined amount of time.

* * * * *